US010692462B2

(12) United States Patent
Imai

(10) Patent No.: US 10,692,462 B2
(45) Date of Patent: Jun. 23, 2020

(54) DISPLAY DEVICE AND METHOD FOR ADJUSTING COMMON VOLTAGE OF DISPLAY DEVICE

(71) Applicant: Japan Display Inc., Tokyo (JP)

(72) Inventor: Ryo Imai, Tokyo (JP)

(73) Assignee: Japan Display Inc., Tokyo (JP)

( * ) Notice: Subject to any disclaimer, the term of this patent is extended or adjusted under 35 U.S.C. 154(b) by 179 days.

(21) Appl. No.: 15/919,905

(22) Filed: Mar. 13, 2018

(65) Prior Publication Data

US 2018/0268773 A1 Sep. 20, 2018

(30) Foreign Application Priority Data

Mar. 17, 2017 (JP) ..... 2017-053517

(51) Int. Cl.

*G09G 5/00* (2006.01)
*G09G 3/36* (2006.01)
*G09G 3/00* (2006.01)

(52) U.S. Cl.

CPC ..... *G09G 3/3696* (2013.01); *G09G 3/006* (2013.01); *G09G 3/3614* (2013.01); *G09G 3/3655* (2013.01); *G09G 3/3677* (2013.01); *G09G 2320/0247* (2013.01)

(58) Field of Classification Search

CPC .... G09G 3/3696; G09G 3/006; G09G 3/3655; G09G 3/3677; G09G 3/3614

See application file for complete search history.

(56) References Cited

U.S. PATENT DOCUMENTS

2004/0036666 A1* 2/2004 Tsutsui ..... G09G 3/3655 345/87
2007/0008266 A1* 1/2007 Kobashi ..... G09G 3/3677 345/90
2007/0024560 A1* 2/2007 Kim ..... G09G 3/3614 345/94
2007/0146276 A1* 6/2007 Syu ..... G09G 3/3655 345/92
2007/0152936 A1* 7/2007 Shin ..... G09G 3/3648 345/92
2008/0117148 A1* 5/2008 Tu ..... G09G 3/3696 345/87
2008/0316154 A1* 12/2008 Kim ..... G09G 3/3655 345/87
2009/0079724 A1* 3/2009 Dou ..... G09G 3/3611 345/212
2011/0221983 A1* 9/2011 Lee ..... G09G 3/3655 349/33
2012/0091997 A1* 4/2012 Huang ..... G09G 3/3648 324/123 R (Continued)

FOREIGN PATENT DOCUMENTS

JP 2000-321595 A 11/2000

*Primary Examiner* — Adam J Snyder
(74) *Attorney, Agent, or Firm* — K&L Gates LLP

(57) ABSTRACT

According to an aspect, a display device includes a common voltage adjuster configured to adjust a common voltage based on a first capacitance value between one of a source and a drain of a transistor element and a gate of the transistor element, a second capacitance value between a pixel electrode and the gate of the transistor element, and a third capacitance value between the pixel electrode and a common electrode.

16 Claims, 10 Drawing Sheets

(56) References Cited

U.S. PATENT DOCUMENTS

| | | | | |
|---|---|---|---|---|
| 2012/0242641 | A1* | 9/2012 | Lee | G09G 3/3655 345/212 |
| 2013/0293526 | A1* | 11/2013 | Igawa | G09G 3/3696 345/212 |
| 2015/0054810 | A1* | 2/2015 | Lin | G09G 3/3696 345/211 |

* cited by examiner

FIG.8

| ΔVp | ΔVp1 | ΔVp2 | ΔVp3 | ΔVp4 | ΔVp5 | ··· |
|---|---|---|---|---|---|---|
| Voft | Voft1 | Voft2 | Voft3 | Voft4 | Voft5 | ··· |

DISPLAY DEVICE AND METHOD FOR ADJUSTING COMMON VOLTAGE OF DISPLAY DEVICE

CROSS-REFERENCE TO RELATED APPLICATIONS

This application claims priority from Japanese Application No. 2017-053517, filed on Mar. 17, 2017, the contents of which are incorporated by reference herein in its entirety.

BACKGROUND

1. Technical Field

The present invention relates to a display device and a method for adjusting a common voltage of the display device.

2. Description of the Related Art

A liquid crystal display device applies an electric field to a liquid crystal layer using pixel electrodes and a common electrode and changes the orientation of liquid crystal molecules to perform display. In a thin film transistor (TFT) liquid crystal display device having TFTs as switching elements, for example, when a thin film transistor is in a conducting state, a pixel signal is applied to a signal line, and even after the thin film transistor becomes a non-conducting state, voltage is retained by accumulated capacitance.

Liquid crystals may be driven with direct current (DC). However, DC drive would degrade the liquid crystals, and thus an inversion driving method is generally used as a method for driving liquid crystals. In the inversion driving method, voltage applied to between the pixel electrodes and the common electrode is inverted between positive polarity and negative polarity at a constant cycle. This inversion driving method is performed by alternating current drive (AC drive), for example. In AC drive, a certain voltage is applied to the common electrode to invert a voltage applied to the pixel electrodes relative to the voltage applied to the common electrode on a frame-by-frame basis, for example. In this process, when a positive voltage and a negative voltage applied to the pixel electrodes are asymmetric relative to the voltage applied to the common electrode, display luminance changes along with polarity inversion of the pixel electrodes, and flickers occur on a display screen.

SUMMARY

According to an aspect, a display device includes: a plurality of pixels provided in a display area of a display unit that displays images, the pixels each including a transistor element; a plurality of signal lines, one of a source and a drain of each transistor element being coupled to a corresponding one of the signal lines; a plurality of scanning lines, a gate of the transistor element being coupled to a corresponding one of the scanning lines; a plurality of pixel electrodes, the other of the source and the drain of the transistor element being coupled to a corresponding one of the pixel electrodes; and a common electrode driver that applies a common voltage to a common electrode. The display device is configured to perform display operation by an inversion driving method that inverts, at a certain cycle, pixel signals to be written into the pixels via the signal lines. The display device further comprises a common voltage adjuster configured to adjust the common voltage based on a first capacitance value between one of the source and the drain of the transistor element and the gate of the transistor element, a second capacitance value between the pixel electrode and the gate of the transistor element, and a third capacitance value between the pixel electrode and the common electrode.

According to another aspect, a method for adjusting a common voltage of a display device, the display device including a display unit that displays images, a plurality of pixels provided in a display area of the display unit, the pixels each including a transistor element, a plurality of signal lines, one of a source and a drain of each transistor element being coupled to a corresponding one of the signal lines, a plurality of scanning lines, a gate of the transistor element being coupled to a corresponding one of the scanning lines, a plurality of pixel electrodes, the other of the source and the drain of the transistor element being coupled to a corresponding one of the pixel electrodes, and a common electrode driver that applies a common voltage to a common electrode, the display device being configured to perform display operation by an inversion driving method that inverts, at a certain cycle, pixel signals to be written into the pixels via the signal lines, the method includes adjusting the common voltage based on a first capacitance value between one of the source and the drain of the transistor element and the gate of the transistor element, a second capacitance value between the pixel electrode and the gate of the transistor element, and a third capacitance value between the pixel electrode and the common electrode.

BRIEF DESCRIPTION OF THE DRAWINGS

FIG. 8 is a diagram of an example of an offset voltage table;

DETAILED DESCRIPTION

Figure 1:
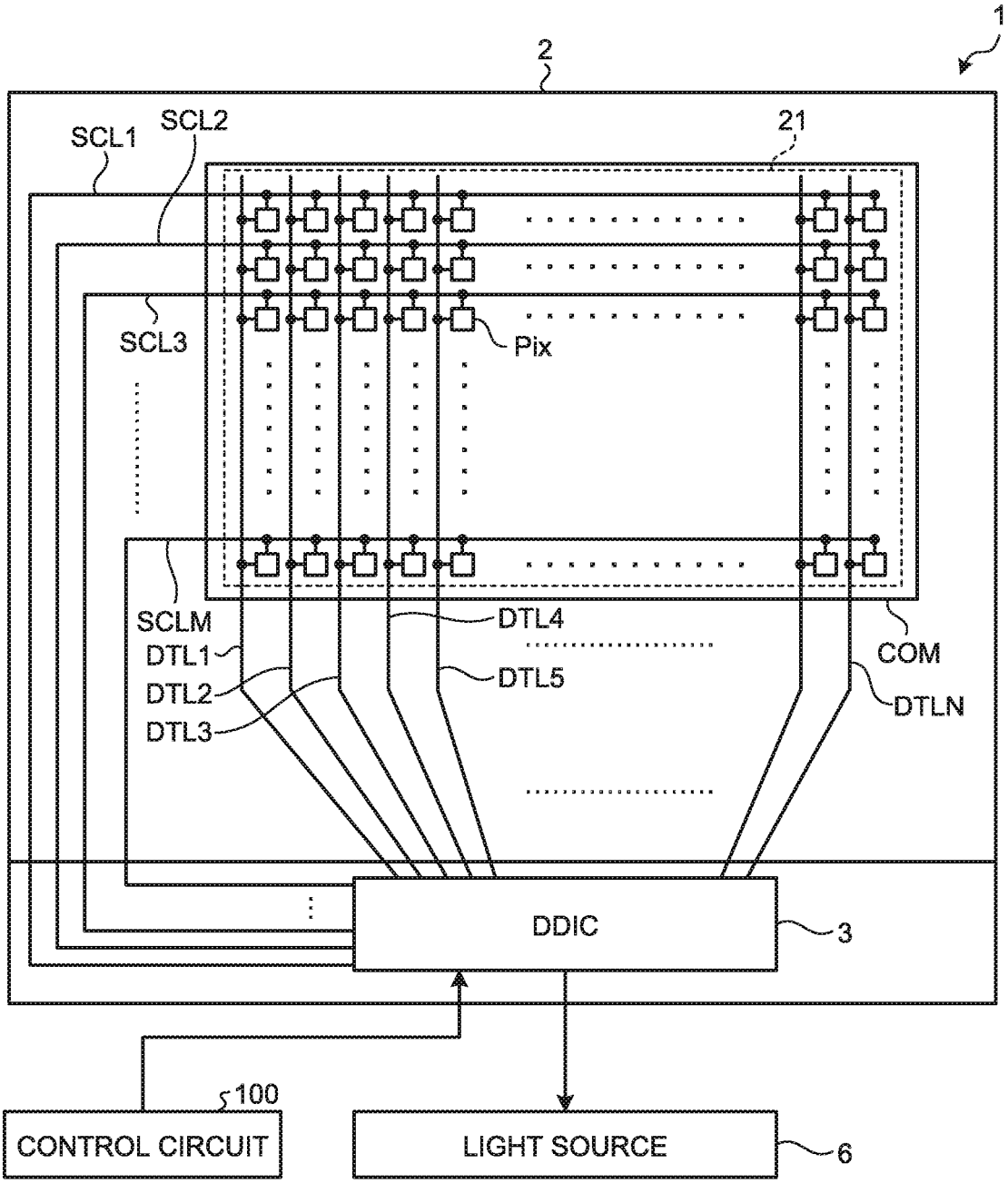
FIG. 1 is a block diagram of a system configuration example of a display device according to an embodiment.

The following describes an embodiment of the present invention with reference to the accompanying drawings. What is disclosed herein is only by way of example, and modifications as appropriate that can be easily thought of with the gist of the invention maintained by those skilled in the art are naturally included in the scope of the present invention. In the drawings, the width, thickness, shape, and the like of parts may be represented schematically compared with actual modes in order to clarify the description; they are only by way of example and do not limit the interpretation of the present invention. In the present specification and the drawings, components similar to those previously described about a previous drawing may be denoted by the same symbols, and detailed descriptions thereof may be omitted as appropriate.

In this disclosure, when an element is described as being "on" another element, the element can be directly on the other element, or there can be one or more elements between the element and the other element.

Embodiment

FIG. 1 is a block diagram of a system configuration example of a display device according to an embodiment. The display device 1 is a transmissive liquid crystal display device, for example, and includes a display panel 2, a display driver integrated circuit (DDIC) 3, and a light source 6.

The display panel 2 functions as a display unit that displays images. Specifically, the display panel 2 includes a translucent insulating substrate such as a glass substrate. A display area 21 is on the surface of the glass substrate, and a plurality of pixels Pix each including a liquid crystal cell are arranged in a matrix (a row-column configuration) in the display area 21, for example. The glass substrate includes a first substrate and a second substrate. A plurality of pixel circuits each including an active element (a transistor, for example) are arranged in a matrix (a row-column configuration) on the first substrate. The second substrate is arranged opposite to the first substrate with a certain gap therebetween. The gap between the first substrate and the second substrate is maintained by photo spacers arranged at some places on the first substrate to have a certain size. The gap between the first substrate and the second substrate is filled with liquid crystals. The arrangement and size of the respective parts such as the display area 21 of the display panel 2 illustrated in FIG. 1 are schematic and do not reflect actual arrangement and the like.

The display area 21 has a matrix (row-column) structure in which the pixels Pix each including a liquid crystal layer are arranged in M rows×N columns. In this specification, the row refers to a pixel row having N pixels Pix arranged in one direction. The column refers to a pixel column having M pixels Pix arranged in a direction orthogonal to a direction in which the rows extend. The values of M and N are defined in accordance with display resolution in a vertical direction and display resolution in a horizontal direction. In the display area 21, scanning lines SCL1, SCL2, SCL3, . . . , and SCLM are arranged for the respective rows, and signal lines DTL1, DTL2, DTL3, . . . , DTLN are arranged for the respective columns in the M-row×N-column arrangement of the pixels Pix. In the present embodiment, the scanning lines SCL1, SCL2, SCL3, . . . , and SCLM may be denoted as a scanning line SCL representing them, and the signal lines DTL1, DTL2, DTL3, . . . , DTLN may be denoted as a signal line DTL representing them.

The pixels Pix may include a plurality of pixel groups with different pixels Pix displaying different colors, each group serving as a unit to display color images on the display area 21. In this case, the pixels Pix of four colors, or R (red), green (G), blue (B), and white (W) may constitute one pixel group, for example, or the pixels Pix of three colors, or R (red), green (G), and blue (B) may constitute one pixel group, for example. The number of the pixels Pix constituting one pixel group and the colors of the respective pixels Pix are not limited to these examples. The arrangement of the pixels Pix constituting one pixel group does not limit the present invention.

The DDIC 3 is a circuit mounted on the glass substrate of the display panel 2 by chip on glass (COG), for example. The DDIC 3 is coupled to an external control circuit 100, an external input power supply, and the like via flexible printed circuits (FPC) (not illustrated). The control circuit 100 transmits, to the DDIC 3, various kinds of signals related to the operation of the display device 1. The external input power supply supplies electric power required for the operation of the DDIC 3. The control circuit 100 is a circuit of an electronic apparatus in which the display device 1 is provided, for example.

Figure 2:
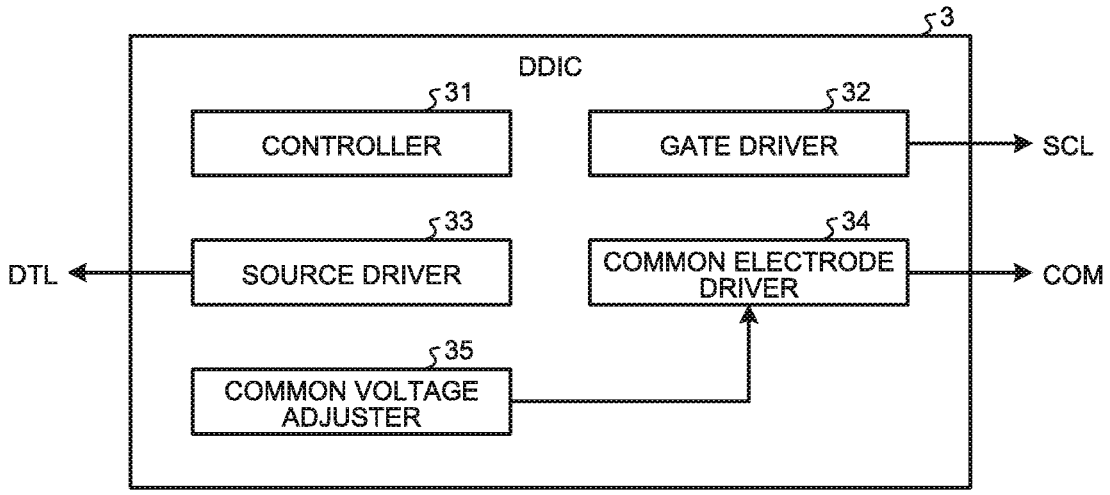
FIG. 2 is a block diagram of a functional configuration example of a DDIC of the display device according to the embodiment.

FIG. 2 is a block diagram of a functional configuration example of the DDIC of the display device according to the embodiment. The DDIC 3 is a drive circuit that drives the display panel 2. Specifically, the DDIC 3 includes a controller 31, a gate driver 32, a source driver 33, a common electrode driver 34, a common voltage adjuster 35, and the like, for example, and outputs various kinds of signals related to the display of images to be performed by the display panel 2 to operate the display panel 2.

More specifically, the DDIC 3 operates the display panel 2 in accordance with various kinds of signals given from the control circuit 100, for example. The control circuit 100 outputs a master clock, a horizontal synchronization signal, a vertical synchronization signal, a display image signal, and the like to the DDIC 3, for example. The controller 31 performs synchronous control when the display panel 2 is operated on the basis of these signals.

The gate driver 32 latches digital data on a horizontal period by horizontal period basis according to the horizontal synchronization signal in synchronization with the vertical synchronization signal and the horizontal synchronization signal. The gate driver 32 outputs one line of the latched digital data successively as a vertical scanning pulse signal and gives the digital data to the scanning lines SCL1, SCL2, SCL3, . . . , and SCLM of the display area 21 to successively select the pixels Pix row by row. As for the row direction, the gate driver 32 outputs the digital data successively from one end side to the other end side of the display area 21, that is, in order of the scanning lines SCL1, SCL2, SCL3, . . . , and SCLM, for example. The gate driver 32 may output the digital data successively from the other end side to the one end side of the display area 21, that is, in order of the scanning lines SCL1, SCL2, SCL3, . . . , and SCLM.

The source driver 33 receives digital data processed on the basis of the display image signal, for example. The source driver 33 writes the display data into the pixels Pix of a row selected by vertical scanning performed by the gate driver 32 via the signal line DTL (signal lines DTL1, DTL2, DTL3, . . . , DTLN) in units of a pixel, in units of a plurality of pixels, or in one unit of all the pixels.

The common electrode driver 34 applies a common voltage Vcom set by the common voltage adjuster 35 to a common electrode COM. The common voltage adjuster 35 will be described below.

In the above example, the gate driver 32, the source driver 33, and the common electrode driver 34 are provided as the components of the DDIC 3, although the gate driver 32, the source driver 33, and the common electrode driver 34 may each be an independent circuit.

The display device 1 according to the present embodiment is assumed to use the inversion driving method that inverts, at a certain cycle, pixel signals to be written into all the pixels simultaneously with the same polarity as a method for driving the liquid crystal panel. The following describes an example in which a frame inversion driving method is used that inverts the pixel signals to be written into all the pixels simultaneously with the same polarity for each successive frame. One frame corresponds to one screen.

Figure 3:
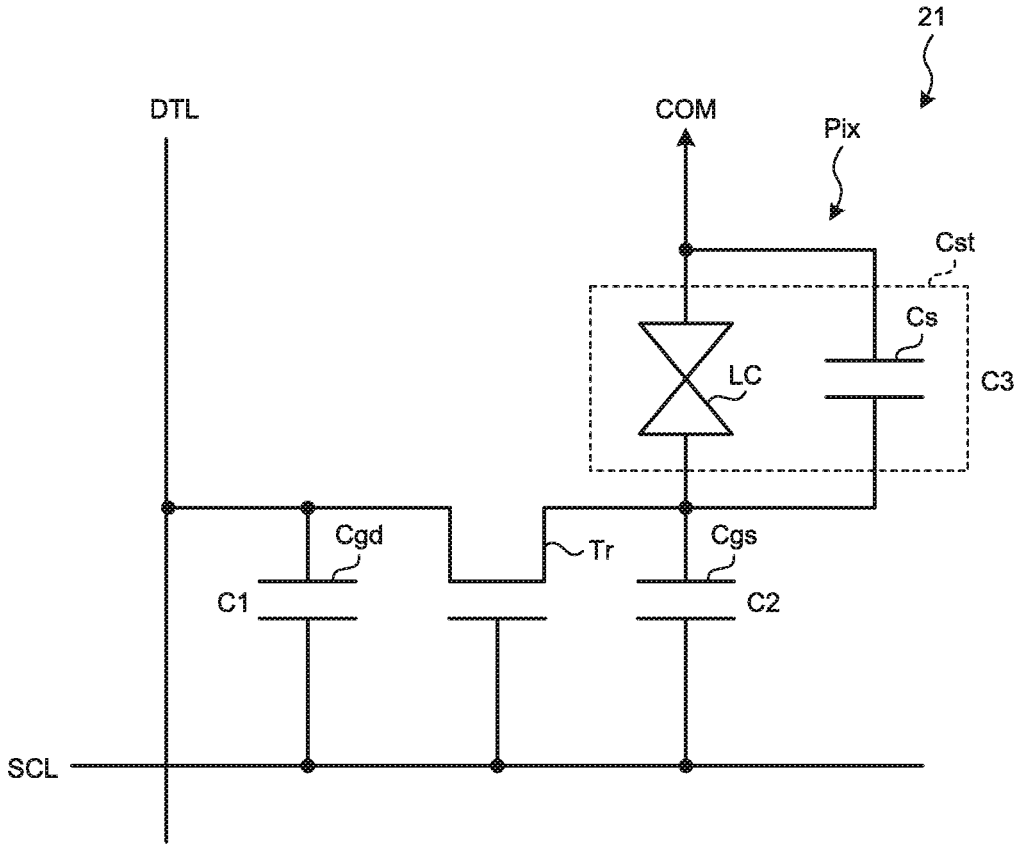
FIG. 3 is a circuit diagram of a drive circuit that drives a pixel of the display device according to the embodiment.

FIG. 3 is a circuit diagram of a drive circuit that drives a pixel of the display device according to the embodiment. FIG. 3 illustrates an example of a drive circuit of one pixel Pix.

The signal lines DTL, the scanning lines SCL, and the common electrode COM are provided on the display area 21. The signal lines DTL supply pixel signals as display data to thin film transistor (TFT) elements Tr of the pixels Pix. The scanning lines SCL drive the TFT elements Tr. Thus, the signal lines DTL extend on a plane parallel to the surface of the glass substrate and supply the pixel signals for displaying an image to the pixels Pix. The pixel Pix includes the TFT element Tr and a liquid crystal element LC. The TFT element Tr includes a thin film transistor. One of a source and a drain of the TFT element Tr is coupled to the signal line DTL, a gate thereof is coupled to the scanning line SCL, and the other of the source and the drain thereof is coupled to one end of the liquid crystal element LC. The one end of the liquid crystal element LC is coupled to the other of the source and the drain of the TFT element Tr, whereas the other end thereof is coupled to the common electrode COM. The one end of the liquid crystal element LC coupled to the other of the source and the drain of the TFT element Tr makes up a pixel electrode.

In the present embodiment, the TFT element Tr is an example of a "transistor element."

The gate driver 32 applies the vertical scanning pulse signal to the gate of the TFT element Tr of the pixel Pix via the scanning line SCL to successively select one line (one horizontal line) as a target of display drive among the pixels Pix formed in a matrix (a row-column configuration) on the display area 21.

The source driver 33 supplies, via the signal line DTL, respective pixel signals to the pixels Pix included in the one horizontal line successively selected by the gate driver 32. With these pixels Pix, display of the one horizontal line is performed in accordance with the supplied pixel signals.

As described above, the gate driver 32 of the display device 1 successively drives and scans each of the scanning lines SCL to successively select one horizontal line. The source driver 33 of the display device 1 supplies the pixel signals to the pixels Pix belonging to the selected one horizontal line via the signal line DTL to perform display for each one horizontal line. When this display operation is performed, the common electrode driver 34 applies the common voltage Vcom to the common electrode COM.

In the following description, one of the source and the drain of the TFT element Tr, which is coupled to the signal line DTL, is also referred to as a first terminal. The gate of the TFT element Tr, which is coupled to the scanning line SCL, is also referred to as a second terminal. The other of the source and the drain of the TFT element Tr, which is coupled to the one end of the liquid crystal element LC, is also referred to as a third terminal.

Between the terminals of the TFT element Tr, respective parasitic capacitances are included. FIG. 3 illustrates an example in which a capacitance element Cgd is included between the first terminal and the second terminal of the TFT element Tr, whereas a capacitance element Cgs is included between the third terminal and the second terminal of the TFT element Tr. In the present embodiment, the capacitance value of the capacitance element Cgd is referred to as a first capacitance value C1, whereas the capacitance value of the capacitance element Cgs is referred to as a second capacitance value C2.

A holding capacitance Cs is included in parallel with the liquid crystal element LC. In the example illustrated in FIG. 3, the capacitance value of a parallel capacitance Cst of the capacitance value of the liquid crystal element LC and the capacitance value of the holding capacitance Cs is referred to as a third capacitance value C3.

Figure 4:
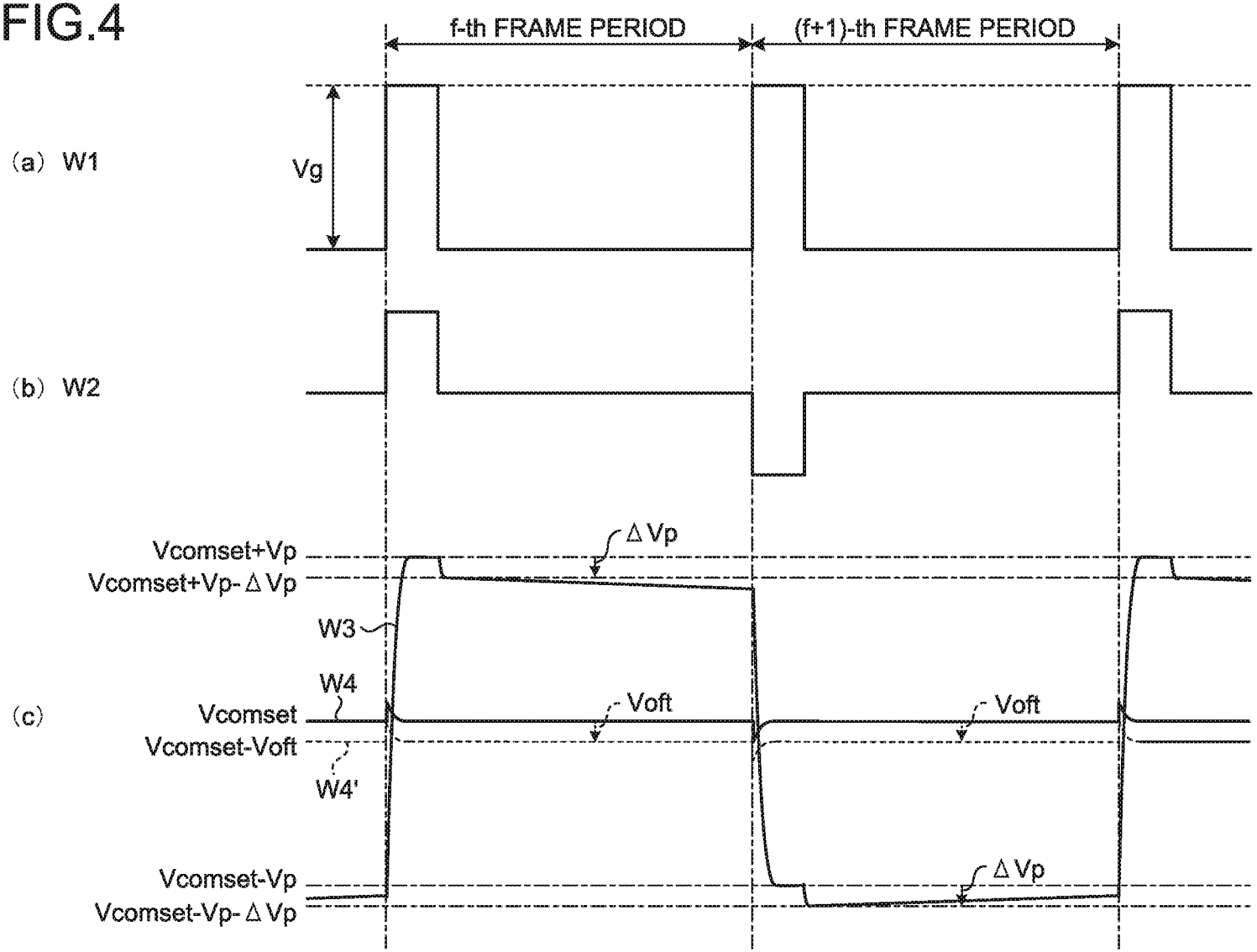
FIG. 4 is a diagram of examples of a vertical scanning pulse signal waveform, a pixel signal waveform, a pixel electrode waveform, and a common voltage waveform.

FIG. 4 is a diagram of examples of a vertical scanning pulse signal waveform, a pixel signal waveform, a pixel electrode waveform, and a common voltage waveform. (a) in FIG. 4 illustrates a vertical scanning pulse signal waveform W1, (b) in FIG. 4 illustrates a pixel signal waveform W2, and (c) in FIG. 4 illustrates a pixel electrode waveform W3 and a common voltage waveform W4.

As described above, the display device 1 according to the present embodiment uses, as the method for driving the liquid crystal panel, the frame inversion driving method that inverts the pixel signals to be written into all the pixels simultaneously with the same polarity for each successive frame. One frame corresponds to one screen. FIG. 4 illustrates an example in which a positive-polarity pixel signal is supplied to the pixel Pix in an f-th frame period (f is any natural number), whereas a negative-polarity pixel signal is supplied thereto in an (f+1)-th frame period. In this case, the pixel electrode waveform W3 is a positive potential relative to the common voltage waveform W4 in the f-th frame period and is a negative potential relative thereto in the (f+1)-th frame period.

In the example illustrated in FIG. 4, as an initial value of the common voltage Vcom to be applied to the common electrode COM, theoretically, the common electrode COM receives an initial value Vcomset that is symmetric between when the potential of the pixel electrode is positive relative to the common voltage Vcom and when the potential of the pixel electrode is negative relative to the common voltage Vcom.

In the example illustrated in FIG. 4, with the common voltage Vcomset applied to the common electrode COM, in the f frame period, when the vertical scanning pulse signal with a wave height value of Vg is applied to the gate (the second terminal) of the TFT element Tr of the pixel Pix via the scanning line SCL to bring the TFT element Tr into a conducting state and to supply the positive-polarity pixel signal to the pixel electrode, the potential of the pixel electrode becomes Vcomset+Vp, which is positive relative to the common voltage Vcomset. After that, when the TFT element Tr becomes a non-conducting state to stop the supply of the positive-polarity pixel signal to the pixel electrode, the potential of the pixel electrode reduces by a penetration voltage (also referred to as a feed-through voltage) of ΔVp caused by the capacitance element Cgs between the third terminal and the second terminal of the TFT element Tr and becomes Vcomset+Vp−ΔVp.

In the subsequent f+1 frame period, when the vertical scanning pulse signal with a wave height value of Vg is applied to the gate (the second terminal) of the TFT element Tr of the pixel Pix via the scanning line SCL to bring the TFT element Tr into a conducting state and to supply the negative-polarity pixel signal to the pixel electrode, the potential of the pixel electrode becomes Vcomset−Vp, which is negative relative to the common voltage Vcomset. After that, when the TFT element Tr becomes a non-conducting state to stop the supply of the negative-polarity pixel signal to the pixel electrode, the potential of the pixel electrode reduces by a penetration voltage of ΔVp caused by the capacitance element Cgs between the third terminal and the second terminal of the TFT element Tr and becomes Vcomset−Vp−ΔVp.

Consequently, in actuality, as illustrated in FIG. 4, after the TFT element Tr has made a transition from a conducting state to a non-conducting state, asymmetry occurs between when the potential of the pixel electrode is positive relative to the initial value Vcomset of the common voltage and when the potential of the pixel electrode is negative relative to the initial value Vcomset, and flickers occur on a display screen.

After the TFT element Tr has made a transition from a conducting state to a non-conducting state, the common voltage Vcom is adjusted so as to cause symmetry between when the potential of the pixel electrode is positive relative to the common voltage and when the potential of the pixel electrode is negative relative to the common voltage, whereby the occurrence of flickers can be lessened. In the example illustrated in FIG. 4, the common voltage is (Vcomset−Voft) obtained by subtracting an offset voltage Voft depending on the penetration voltage ΔVp from the initial value Vcomset of the common voltage Vcom (W4' illustrated in (c) in FIG. 4). This processing maintains the symmetry between the positive potential and the negative potential of the pixel electrode relative to the common voltage Vcomset−Voft after the TFT element Tr has made a transition from a conducting state to a non-conducting state and lessens the occurrence of flickers.

The penetration voltage ΔVp is represented by the following Equation (1) using the capacitance values illustrated in FIG. 3.

$$\Delta Vp=(C2/(C2+C3))\times Vg \quad (1)$$

The symbol Vg in Equation (1) is a wave height value of the vertical scanning pulse signal to be applied to the gate (the second terminal) of the TFT element Tr of the pixel Pix via the scanning line SCL when the display operation of the display device 1 according to the first embodiment is performed. In Equation (1), the second capacitance value C2 is the capacitance value of the capacitance element Cgs, and the third capacitance value C3 is the capacitance value of the parallel capacitance Cst of the capacitance value of the liquid crystal element LC and the capacitance value of the holding capacitance Cs. Consequently, the second capacitance value C2 and the third capacitance value C3 are determined, whereby the penetration voltage ΔVp can be obtained from Equation (1).

Figure 5:
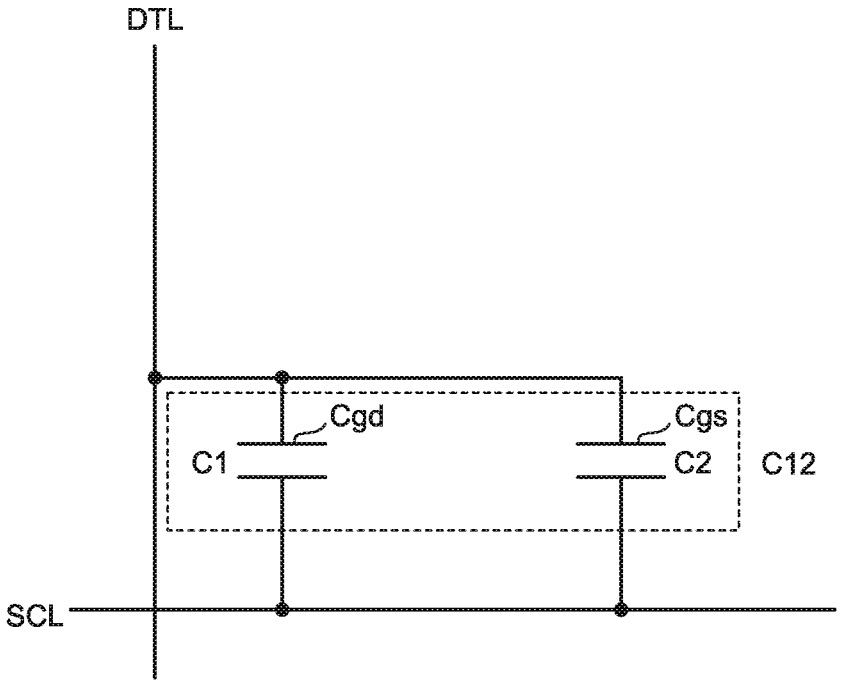
FIG. 5 is a diagram of an equivalent circuit of the drive circuit illustrated in FIG. 3 when a TFT element is in a conducting state.
Figure 6:
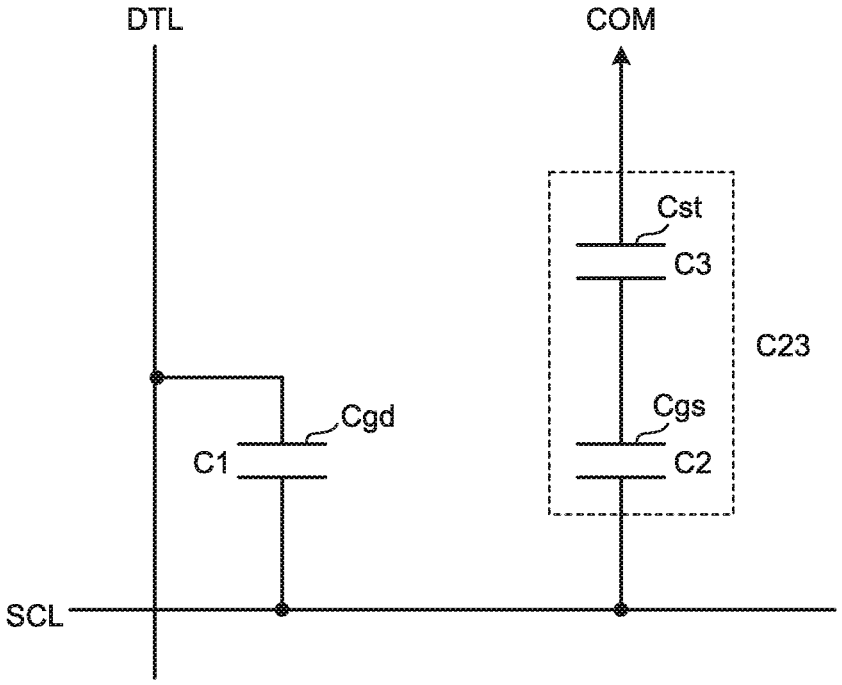
FIG. 6 is a diagram of an equivalent circuit of the drive circuit illustrated in FIG. 3 when the TFT element is in a non-conducting state.

The following describes a method for calculating the second capacitance value C2 and the third capacitance value C3. FIG. 5 is a diagram of an equivalent circuit of the drive circuit illustrated in FIG. 3 when the TFT element is in a conducting state. FIG. 6 is a diagram of an equivalent circuit of the drive circuit illustrated in FIG. 3 when the TFT element is in a non-conducting state.

As illustrated in FIG. 5, when the TFT element Tr is in a conducting state, the capacitance element Cgd and the capacitance element Cgs are present in parallel between the signal line DTL and the scanning line SCL. Consequently, a parallel capacitance value C12 of the capacitance element Cgd and the capacitance element Cgs is represented by the following Equation (2).

$$C12=C1+C2 \quad (2)$$

As illustrated in FIG. 6, when the TFT element Tr is in a non-conducting state, the capacitance element Cgs and the parallel capacitance element Cst are present in series between the common electrode COM and the scanning line SCL. Consequently, a series capacitance value C23 of the capacitance element Cgs and the parallel capacitance Cst is represented by the following Equation (3).

$$C23=C2\times C3/(C2+C3) \quad (3)$$

As illustrated in FIG. 6, when the TFT element Tr is in a non-conducting state, the capacitance element Cgd is present between the signal line DTL and the scanning line SCL.

Consequently, the second capacitance value C2 as the capacitance value of the capacitance element Cgs is represented by the following Equation (4) using the parallel capacitance value C12 obtained when the TFT element Tr is in a conducting state and the first capacitance value C1 as the capacitance value of the capacitance element Cgd obtained when the TFT element Tr is in a non-conducting state.

$$C2=C12-C1 \quad (4)$$

The third capacitance value C3, which is the capacitance value of the parallel capacitance Cst of the capacitance value of the liquid crystal element LC and the capacitance value of the holding capacitance Cs, is represented by the following Equation (5) using the second capacitance value C2 obtained by Equation (4) and the series capacitance value C23 obtained when the TFT element Tr is in a non-conducting state.

$$C3=C2\times C23/(C2-C23) \quad (5)$$

Consequently, by detecting the parallel capacitance value C12 of the capacitance element Cgd and the capacitance element Cgs when the TFT element Tr is in a conducting state, the series capacitance value C23 of the capacitance element Cgs and the parallel capacitance Cst when the TFT element Tr is in a non-conducting state, and the first capacitance value C1 as the capacitance value of the capacitance element Cgd when the TFT element Tr is in a non-conducting state, the penetration voltage ΔVp can be obtained.

Figure 7:
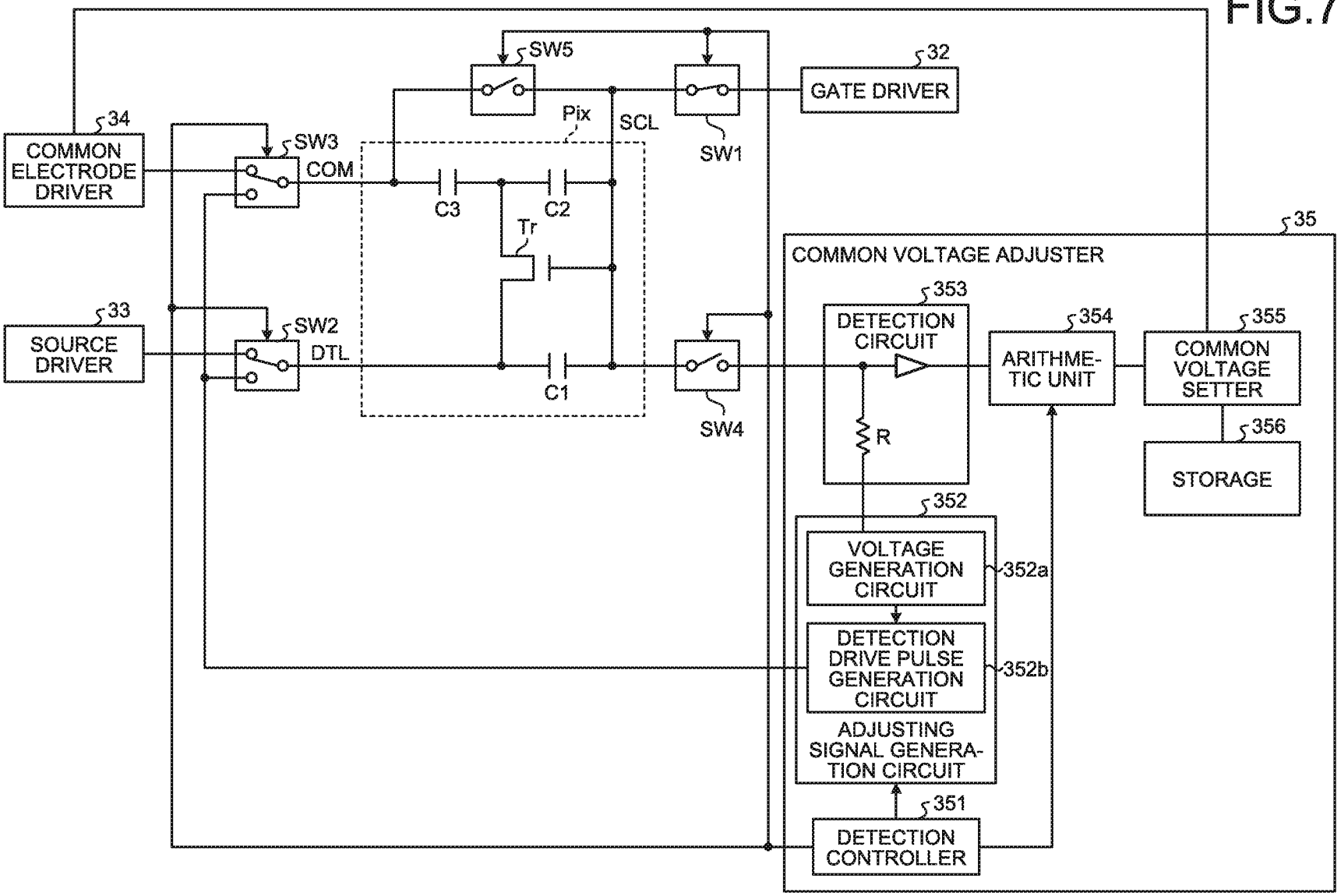
FIG. 7 is a schematic circuit diagram of an example of components related to the operation of a common voltage adjuster.

FIG. 7 is a schematic circuit diagram of an example of components related to the operation of the common voltage adjuster. FIG. 7 illustrates an example of a schematic configuration of one pixel Pix. As illustrated in FIG. 7, by performing capacitance detection of the parallel capacitance value C12 when the TFT element Tr is in a conducting state, the series capacitance value C23 when the TFT element Tr is in a non-conducting state, and the first capacitance value C1 when the TFT element Tr is in a non-conducting state for at least one pixel Pix, the penetration voltage ΔVp can be obtained. As described below, capacitance detection may be performed for one row including a plurality of pixels Pix coupled to the scanning line SCL in parallel.

When the display operation of the display device 1 according to the present embodiment is performed, the vertical scanning pulse signal with a wave height value of Vg is supplied to the scanning line SCL from the gate driver 32 via a first switch SW1 and is applied to the gate (the second terminal) of the TFT element Tr of the pixel Pix. When the display operation of the display device 1 according to the present embodiment is performed, the pixel signal is supplied to the signal line DTL from the source driver 33 via a second switch SW2 and is applied to the one (the first terminal) of the source and the drain of the TFT element Tr of the pixel Pix. When the display operation of the display device 1 according to the present embodiment is performed, the common voltage is applied to the common electrode COM from the common electrode driver 34 via a third switch SW3. When the display operation of the display device 1 according to the present embodiment is performed, a fifth switch SW5 is controlled to be off.

In the example illustrated in FIG. 7, the first switch SW1, the second switch SW2, and the third switch SW3 are provided for the scanning line SCL, the signal line DTL, and the common electrode COM, respectively. In the configuration of the present embodiment as illustrated in FIG. 1, the display area 21 has the matrix (row-column) structure in which the pixels Pix each including the liquid crystal layer are arranged in M rows×N columns, the first switch SW1 is provided for each of the scanning line SCL (the scanning lines SCL1, SCL2, SCL3, . . . , and SCLM), the second switch SW2 is provided for each of the signal line DTL (the signal lines DTL1, DTL2, DTL3, . . . , DTLN), and the sole third switch SW3 is provided for the common electrode COM.

The common voltage adjuster 35 includes a detection controller 351, an adjusting signal generation circuit 352, a detection circuit 353, an arithmetic unit 354, a common voltage setter 355, and a storage 356. The detection controller 351, the adjusting signal generation circuit 352, the detection circuit 353, the arithmetic unit 354, the common voltage setter 355, and the storage 356 are circuits configured in the DDIC 3, for example. The detection controller 351 may be implemented by a computer program executed by the controller 31 of the DDIC 3, for example. The storage 356 may be configured by a register or the like provided in the DDIC 3, for example.

The detection circuit 353 is coupled with the scanning line SCL via a fourth switch SW4. The detection circuit 353 observes the transient characteristics of the voltage of the scanning line SCL to detect the parallel capacitance value C12 of the capacitance element Cgd and the capacitance element Cgs, the series capacitance value C23 of the capacitance element Cgs and the parallel capacitance Cst, and the first capacitance value C1 as the capacitance value of the capacitance element Cgd.

The arithmetic unit 354 calculates the penetration voltage ΔVp on the basis of the parallel capacitance value C12, the series capacitance value C23, and the first capacitance value C1 detected by the detection circuit 353. More specifically, the arithmetic unit 354 determines the second capacitance value C2 as the capacitance value of the capacitance element Cgs using Equation (2). The arithmetic unit 354 determines the third capacitance value C3 using Equation (3), the third capacitance value C3 being the capacitance value of the parallel capacitance Cst of the capacitance value of the liquid crystal element LC and the capacitance value of the holding capacitance Cs. The arithmetic unit 354 substitutes the determined second capacitance value C2 and third capacitance value C3 into Equation (1) to calculate the penetration voltage ΔVp.

The storage 356 stores therein an offset voltage table that associates the offset voltage Voft with the penetration voltage ΔVp in advance. The storage 356 stores therein the wave height value Vg of the vertical scanning pulse signal and the initial value Vcomset of the common voltage Vcom.

FIG. 8 is a diagram of an example of the offset voltage table. The offset voltage table stores an optimum value of the offset voltage Voft depending on the penetration voltage ΔVp. In other words, in the common voltage setter 355 described below, the optimum value of the offset voltage Voft depending on the penetration voltage ΔVp is used for the initial value Vcomset of the common voltage Vcom to set the common voltage to be applied to the common electrode COM from the common electrode driver 34 when the display operation of the display device 1 is performed, whereby flickers caused by the penetration voltage ΔVp can be lessened to a visibility limit or less.

FIG. 8 illustrates an example in which the optimum value of the offset voltage Voft depending on the penetration voltage ΔVp is set in the offset voltage table, although the penetration voltage ΔVp calculated using Equation (1) may be used for the common voltage Vcom in advance as the offset voltage Voft in a design stage.

The common voltage setter 355 in the present embodiment refers to the storage 356, subtracts the offset voltage Voft depending on the penetration voltage ΔVp from the initial value Vcomset of the common voltage Vcom to determine Vcomset−Voft, and sets this Vcomset−Voft as the common voltage to be applied to the common electrode COM from the common electrode driver 34 when the display operation of the display device 1 is performed.

The adjusting signal generation circuit 352 includes a voltage generation circuit 352*a* and a detection drive pulse generation circuit 352*b*. The voltage generation circuit 352*a* generates voltage to be supplied to the detection circuit 353, and the detection drive pulse generation circuit 352*b* generates a detection drive pulse to be applied to the signal line DTL or the common electrode COM.

The voltage generation circuit 352*a* generates a first voltage V1 that brings the TFT element Tr into a non-conducting state or a second voltage V2 that brings the TFT element Tr into a conducting state. The first voltage V1 and the second voltage V2 are different voltages; when the TFT element Tr is an n-type one, V1<V2 is satisfied, and when the TFT element Tr is a p-type one, V1>V2 is satisfied.

The detection drive pulse generation circuit 352*b* generates a detection drive pulse with a wave height value of Vp for the first voltage V1 or the second voltage V2 generated by the voltage generation circuit 352*a*.

In common voltage adjustment processing described below, the detection controller 351 controls control timing of the voltage and the detection drive pulse supplied from the adjusting signal generation circuit 352, arithmetic processing timing of the arithmetic unit 354, switching timing of the first switch SW1, the second switch SW2, the third switch SW3, the fourth switch SW4, and the fifth switch SW5, and the like.

The following describes specific examples of capacitance detection operation and operation for adjusting the common voltage Vcom in the common voltage adjustment processing performed by the common voltage adjuster 35. In the capacitance detection operation and the operation for adjusting the common voltage Vcom of the present embodiment, capacitance detection is performed for one row of pixels Pix coupled to the scanning line SCL in parallel, that is, N pixels Pix. Thus, Equation (1), Equation (2), Equation (3), Equation (4), and Equation (5) are replaced with the following Equation (6), Equation (7), Equation (8), Equation (9), and Equation (10), respectively.

$$\Delta Vp=(N>C2/(N\times C2+N\times C3))\times Vg \quad (6)$$

$$N\times C12=N\times C1+N\times C2 \quad (7)$$

$$N\times C23=N\times C2\times N\times C3/(N\times C2+N\times C3) \quad (8)$$

$$N\times C2=N\times C12-N\times C1 \quad (9)$$

$$N\times C3=N\times C2\times N\times C23/(N\times C2-N\times C23) \quad (10)$$

Figure 9:
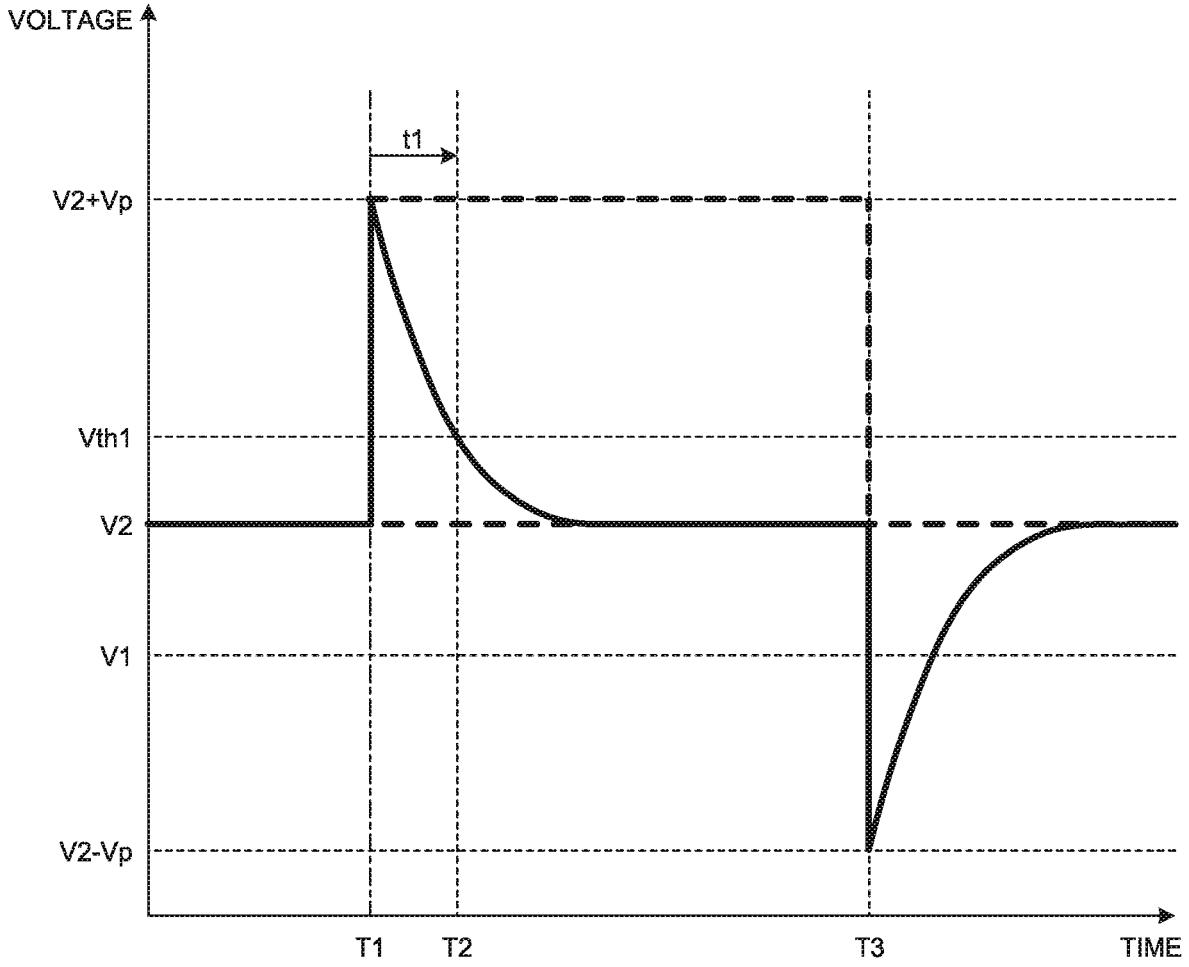
FIG. 9 is an illustrative diagram of an operation example when a parallel capacitance value is detected.
Figure 10:
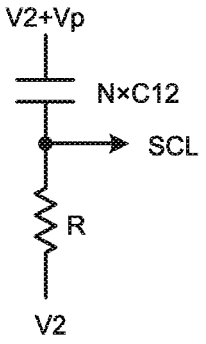
FIG. 10 is a diagram of an equivalent circuit when the parallel capacitance value is detected.

The following first describes operation for detecting a parallel capacitance value N×C12 of one row of pixels Pix. In the following description, described is an operation example when the TFT element Tr is an n-type one. FIG. 9 is an illustrative diagram of an operation example when the parallel capacitance value is detected. FIG. 10 is a diagram of an equivalent circuit when the parallel capacitance value is detected. In the present embodiment, the parallel capacitance value N×C12 is detected using the transient characteristics of a detected voltage Vdet at the rising edge of the detection drive pulse.

First, the detection controller 351 controls the first switch SW1 to be off so as to decouple the gate driver 32 from the scanning line SCL, controls the second switch SW2 so as to decouple the source driver 33 from the signal line DTL and couple the detection drive pulse generation circuit 352*b* with the signal line DTL to supply the detection drive pulse to the signal line DTL, controls the third switch SW3 to be off so as to decouple the common electrode driver 34 from the common electrode COM and decouple the detection drive pulse generation circuit 352*b* from the common electrode COM, controls the fourth switch SW4 to be on so as to supply voltage to the scanning line SCL from the voltage generation circuit 352*a* via a resistor R of the detection circuit 353, and controls the fifth switch SW5 to be off so as to decouple the common electrode COM from the scanning line SCL.

The detection controller 351 performs control so as to output the second voltage V2 from the voltage generation circuit 352*a*. With this control, the TFT element Tr is controlled to be in a conducting state. The detection controller 351 performs control so as to output the detection drive pulse with a wave height value of Vp from the detection drive pulse generation circuit 352*b* to the second voltage V2.

The arithmetic unit 354 monitors the detected voltage Vdet detected by the detection circuit 353 and detects an elapsed time t1 from a rising time T1 of the detection drive pulse to a time T2 at which the detected voltage Vdet is equal to or greater than a certain first threshold Vth1 (V2<Vth1<V2+Vp). In this process, the parallel capacitance value N×C12, a value of the resistor R, the wave height value Vp of the detection drive pulse, the first threshold Vth1, and the elapsed time t1 are represented by the following Equation (11).

$$Vth1=Vp\times\exp(t1/(N\times C12\times R)) \quad (11)$$

The arithmetic unit 354 calculates the parallel capacitance value N×C12 using Equation (11).

In the above example, the elapsed time t1 from the rising time T1 of the detection drive pulse to the time T2 at which the detected voltage Vdet is equal to or greater than the certain first threshold Vth1 is detected. A time from a falling time T3 of the detection drive pulse to a time at which the detected voltage is equal to or less than a certain threshold may be detected to calculate the parallel capacitance value N×C12.

Figure 11:
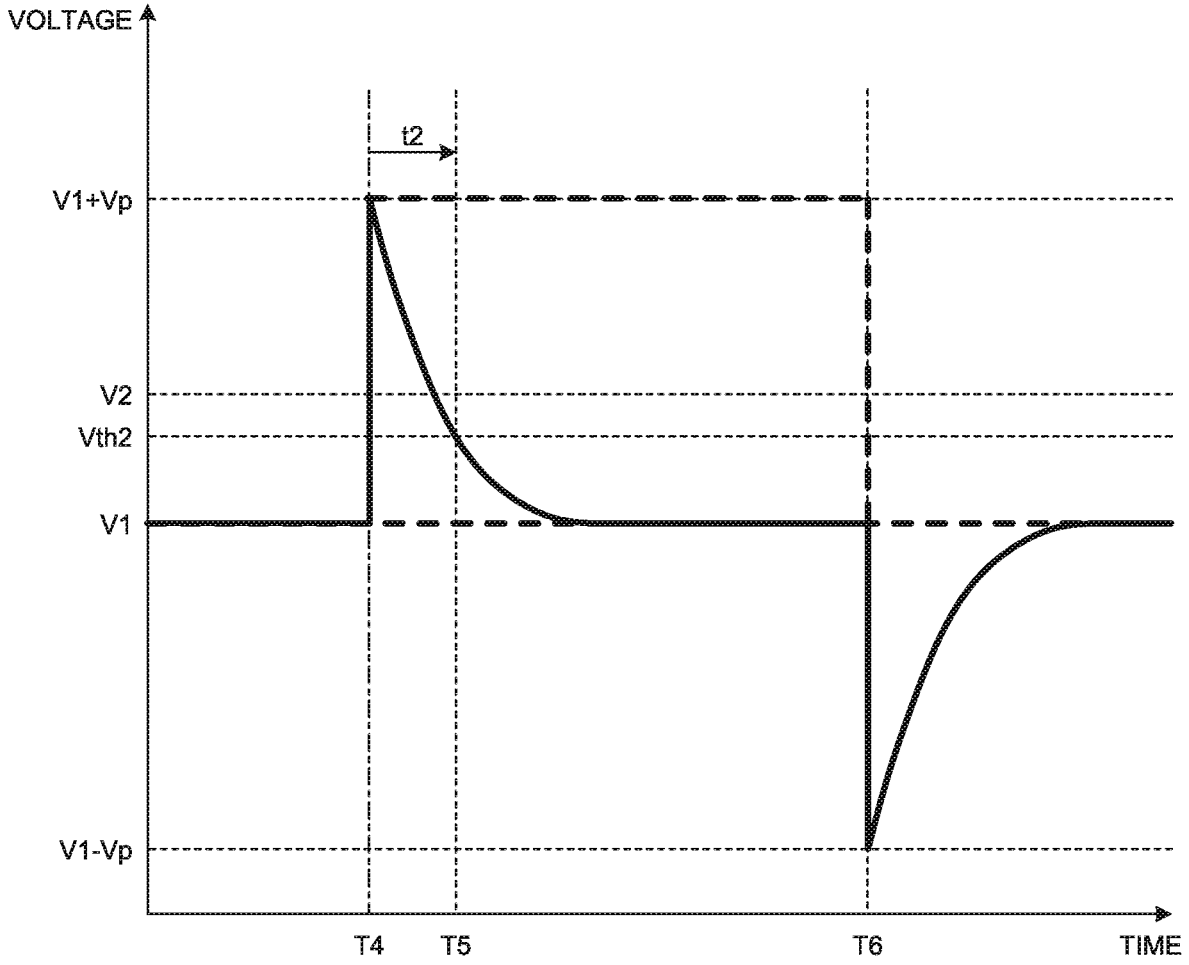
FIG. 11 is an illustrative diagram of an operation example when a first capacitance value is detected.
Figure 12:
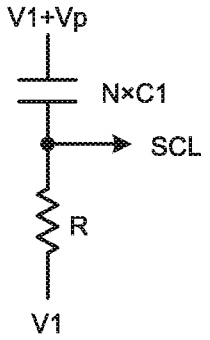
FIG. 12 is a diagram of an equivalent circuit when the first capacitance value is detected.

The following describes operation for detecting a first capacitance value N×C1 of one row of pixels Pix. FIG. 11 is an illustrative diagram of an operation example when the first capacitance value is detected. FIG. 12 is a diagram of an equivalent circuit when the first capacitance value is detected. In the present embodiment, the first capacitance value N×C1 is detected using the transient characteristics of the detected voltage Vdet at the rising edge of the detection drive pulse.

First, the detection controller 351 controls the first switch SW1 to be off so as to decouple the gate driver 32 from the scanning line SCL, controls the second switch SW2 so as to couple the detection drive pulse generation circuit 352*b* with the signal line DTL to supply the detection drive pulse to the signal line DTL, controls the third switch SW3 to be off so as to decouple the common electrode driver 34 from the common electrode COM and decouple the detection drive pulse generation circuit 352*b* from the common electrode COM, controls the fourth switch SW4 to be on so as to supply voltage to the scanning line SCL from the voltage generation circuit 352*a* via the resistor R of the detection circuit 353, and controls the fifth switch SW5 to be on or off so as to couple the common electrode COM with the scanning line SCL.

The detection controller 351 performs control so as to output the first voltage V1 from the voltage generation circuit 352*a*. With this control, the TFT element Tr is controlled to be in a non-conducting state. The detection controller 351 performs control so as to output the detection drive pulse with a wave height value of Vp from the detection drive pulse generation circuit 352*b* to the first voltage V1.

The arithmetic unit 354 monitors the detected voltage Vdet detected by the detection circuit 353 and detects an elapsed time t2 from a rising time T4 of the detection drive pulse to a time T5 at which the detected voltage Vdet is equal to or greater than a certain second threshold Vth2 (V1<Vth2<V1+Vp). In this process, the first capacitance value N×C1, a value of the resistor R, the wave height value Vp of the detection drive pulse, the second threshold Vth2, and the elapsed time t2 are represented by the following Equation (12).

$$Vth2=Vp\times\exp(t2/(N\times C1\times R)) \quad (12)$$

The arithmetic unit 354 calculates the first capacitance value N×C1 using Equation (12).

In the above example, the elapsed time t2 from the rising time T4 of the detection drive pulse to the time T5 at which the detected voltage Vdet is equal to or greater than the certain second threshold Vth2 is detected. A time from a falling time T6 of the detection drive pulse to a time at which the detected voltage is equal to or less than a certain threshold may be detected to calculate the first capacitance value N×C1.

Figure 13:
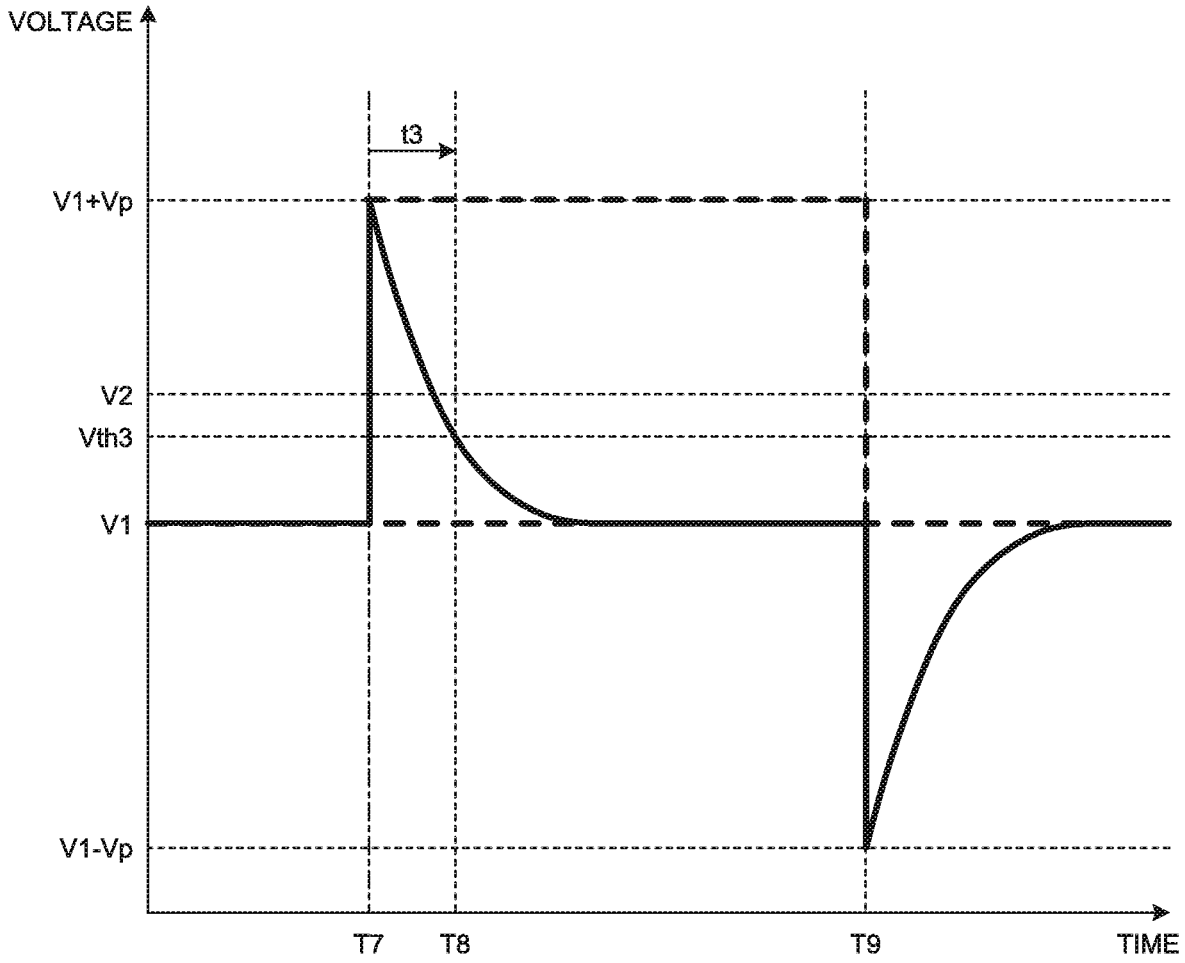
FIG. 13 is an illustrative diagram of an operation example when a series capacitance value is detected.
Figure 14:
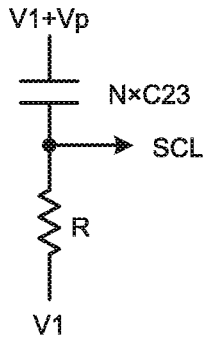
FIG. 14 is a diagram of an equivalent circuit when the series capacitance value is detected.

The following describes operation for detecting a series capacitance value N×C23 of one row of pixels Pix. FIG. 13 is an illustrative diagram of an operation example when the series capacitance value is detected. FIG. 14 is a diagram of an equivalent circuit when the series capacitance value is detected. In the present embodiment, the series capacitance value N×C23 is detected using the transient characteristics of the detected voltage Vdet at the rising edge of the detection drive pulse.

First, the detection controller 351 controls the first switch SW1 to be off so as to decouple the gate driver 32 from the scanning line SCL, controls the second switch SW2 so as to decouple the source driver 33 from the signal line DTL and decouple the detection drive pulse generation circuit 352*b* from the signal line DTL, controls the third switch SW3 so as to couple the detection drive pulse generation circuit 352*b* with the common electrode COM to supply the detection drive pulse to the common electrode COM, controls the fourth switch SW4 to be on so as to supply voltage to the scanning line SCL from the voltage generation circuit 352*a* via the resistor R of the detection circuit 353, and controls the fifth switch SW5 to be off so as to decouple the common electrode COM from the scanning line SCL.

The detection controller 351 performs control so as to output the first voltage V1 from the voltage generation circuit 352*a*. With this control, the TFT element Tr is controlled to be in a non-conducting state. The detection controller 351 performs control so as to output the detection drive pulse with a wave height value of Vp from the detection drive pulse generation circuit 352*b* to the first voltage V1.

The arithmetic unit 354 monitors the detected voltage Vdet detected by the detection circuit 353 and detects an elapsed time t3 from a rising time T7 of the detection drive pulse to a time T8 at which the detected voltage Vdet is equal to or greater than a certain third threshold Vth3 (V1<Vth3<V1+Vp). In this process, the series capacitance value N×C23, a value of the resistor R, the wave height value Vp of the detection drive pulse, the third threshold Vth3, and the elapsed time t3 are represented by the following Equation (13).

$$Vth3=Vp\times\exp(t3/(N\times C23\times R)) \quad (13)$$

The arithmetic unit 354 calculates the series capacitance value N×C23 using Equation (13).

In the above example, the elapsed time t3 from the rising time T7 of the detection drive pulse to the time T8 at which the detected voltage Vdet is equal to or greater than the certain third threshold Vth3 is detected. A time from a falling time T9 of the detection drive pulse to a time at which the detected voltage is equal to or less than a certain threshold may be detected to calculate the series capacitance value N×C23.

The wave height value Vp of the detection drive pulse may be different or the same between when the parallel capacitance value N×C12 is calculated, when the first capacitance value N×C1 is calculated, and when the series capacitance value N×C23 is calculated. The first threshold Vth1 when the parallel capacitance value N×C12 is calculated, the second threshold Vth2 when the first capacitance value N×C1 is calculated, and the third threshold Vth3 when the series capacitance value N×C23 is calculated may be different voltage values or the same voltage value.

The following describes operation for adjusting the common voltage Vcom.

The arithmetic unit 354 calculates the penetration voltage ΔVp on the basis of the parallel capacitance value N×C12, the first capacitance value N×C1, and the series capacitance value N×C23 determined as described above.

More specifically, the arithmetic unit 354 substitutes the parallel capacitance value N×C12 and the first capacitance value N×C1 into Equation (9) to determine a second capacitance value N×C2.

Subsequently, the arithmetic unit 354 substitutes the second capacitance value N×C2 and the series capacitance value N×C23 into Equation (10) to determine a third capacitance value N×C3.

The arithmetic unit 354 then substitutes the second capacitance value N×C2 determined by Equation (9) and the third capacitance value N×C3 determined by Equation (10) into Equation (6) to determine the penetration voltage ΔVp.

The common voltage setter 355 determines the common voltage Vcom to be used when the display operation of the display device 1 is performed, using the offset voltage table stored in the storage 356 in advance. More specifically, the common voltage setter 355 selects the offset voltage Voft depending on the penetration voltage ΔVp calculated by the arithmetic unit 354, on the basis of the offset voltage table stored in the storage 356.

The common voltage setter 355 then subtracts the selected offset voltage Voft from the initial value Vcomset of the common voltage Vcom stored in the storage 356 to calculate the common voltage to be used when the display operation is performed (Vcom=Vcomset−Voft).

In the display device 1 according to the present embodiment, the display operation is performed using the common voltage Vcom (=Vcomset−Voft) determined as described above, thereby maintaining the symmetry between the positive potential and the negative potential of the pixel electrode relative to the common voltage Vcomset−Voft after the TFT element Tr has made transition from a conducting state to a non-conducting state. This can lessen the occurrence of flickers.

Figure 15:
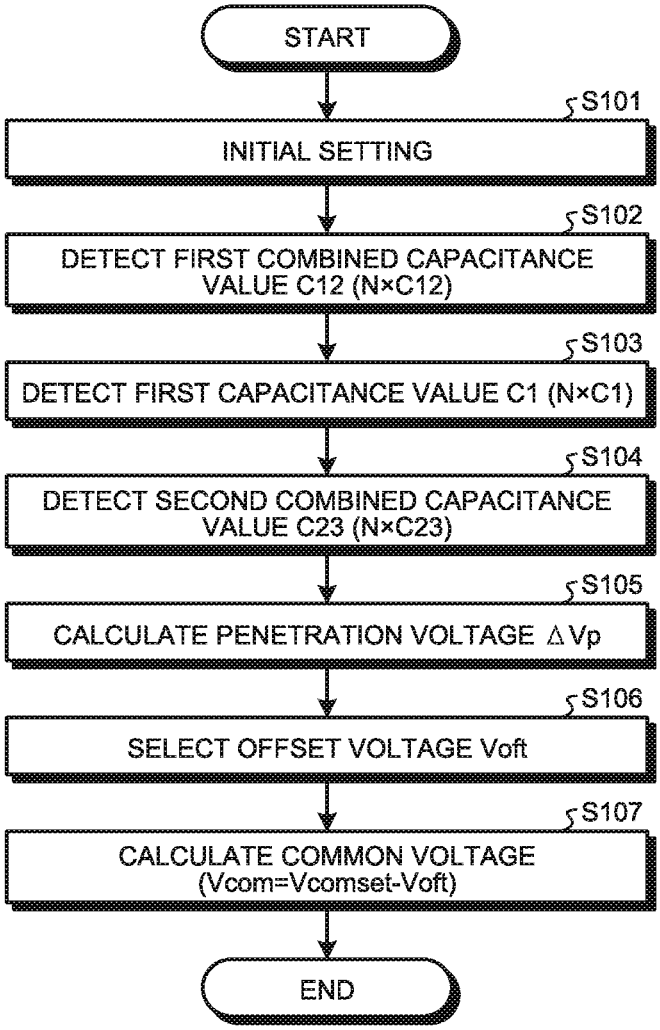
FIG. 15 is a flowchart of an example of common voltage adjustment processing executed by the common voltage adjuster of the display device according to the embodiment.

The following describes the common voltage adjustment processing executed by the common voltage setter of the display device according to the embodiment. FIG. 15 is a flowchart of an example of the common voltage adjustment processing executed by the common voltage adjuster of the display device according to the embodiment.

The common voltage adjuster 35 performs initial setting for starting the common voltage adjustment processing (Step S101).

Specifically, the detection controller 351 controls the first switch SW1 to be off so as to decouple the gate driver 32 from the scanning line SCL, controls the second switch SW2 so as to decouple the source driver 33 from the signal line DTL and couple the detection drive pulse generation circuit 352*b* with the signal line DTL to supply the detection drive pulse to the signal line DTL, controls the third switch SW3 to be off so as to decouple the common electrode driver 34 from the common electrode COM and decouple the detection drive pulse generation circuit 352*b* from the common electrode COM, controls the fourth switch SW4 to be on so as to supply the voltage to the scanning line SCL from the voltage generation circuit 352*a* via the resistor R of the detection circuit 353, and controls the fifth switch SW5 to be off so as to decouple the common electrode COM from the scanning line SCL.

After the initial setting, the common voltage adjuster 35 detects the parallel capacitance value C12 (N×C12 in this example) as a combined capacitance value of the capacitance element Cgd and the capacitance element Cgs with the TFT element Tr controlled to be on (Step S102). The parallel capacitance value C12 is a first combined capacitance value.

Specifically, the detection controller 351 performs control so as to output the second voltage V2 from the voltage generation circuit 352*a*. With this control, the TFT element Tr is controlled to be in a conducting state. The detection controller 351 performs control so as to output the detection drive pulse with a wave height value of Vp from the detection drive pulse generation circuit 352*b* to the second voltage V2.

The arithmetic unit 354 monitors the detected voltage Vdet detected by the detection circuit 353, detects the elapsed time t1 from the rising time T1 of the detection drive pulse to the time T2 (refer to FIG. 9) at which the detected voltage Vdet is equal to or greater than the certain first threshold Vth1 (V2<Vth1<V2+Vp), and calculates the parallel capacitance value N×C12 using Equation (11).

Subsequently, the common voltage adjuster 35 detects the first capacitance value C1 (N×C1 in this example) as the capacitance value of the capacitance element Cgd with the TFT element Tr controlled to be off (Step S103).

Specifically, the detection controller 351 first controls the fifth switch SW5 to be on so as to couple the common electrode COM and the scanning line SCL.

The detection controller 351 performs control so as to output the first voltage V1 from the voltage generation circuit 352*a*. With this control, the TFT element Tr is controlled to be in a non-conducting state. The detection controller 351 performs control so as to output the detection drive pulse with a wave height value of Vp from the detection drive pulse generation circuit 352*b* to the first voltage V1.

The arithmetic unit 354 monitors the detected voltage Vdet detected by the detection circuit 353, detects the elapsed time t2 from the rising time T4 of the detection drive pulse to the time T5 (refer to FIG. 11) at which the detected voltage Vdet is equal to or greater than the certain second threshold Vth2 (V1<Vth2<V1+Vp), and calculates the first capacitance value N×C1 using Equation (12).

Subsequently, the common voltage adjuster 35 detects the series capacitance value C23 (N×C23 in this example) as the combined capacitance value of the capacitance element Cgs and the parallel capacitance Cst with the TFT element Tr controlled to be off (Step S104). The series capacitance value C23 is a second combined capacitance value.

Specifically, the detection controller 351 controls the second switch SW2 so as to decouple the source driver 33 from the signal line DTL and decouple the detection drive pulse generation circuit 352*b* from the signal line DTL, controls the third switch SW3 so as to couple the detection drive pulse generation circuit 352*b* with the common electrode COM to supply the detection drive pulse to the common electrode COM, and controls the fifth switch SW5 to be off so as to decouple the common electrode COM from the scanning line SCL.

The detection controller 351 performs control so as to output the first voltage V1 from the voltage generation circuit 352*a*. With this control, the TFT element Tr is controlled to be in a non-conducting state. The detection controller 351 performs control so as to output the detection drive pulse with a wave height value of Vp from the detection drive pulse generation circuit 352*b* to the first voltage V1.

The arithmetic unit 354 monitors the detected voltage Vdet detected by the detection circuit 353, detects the elapsed time t3 from the rising time T7 of the detection drive pulse to the time T8 (refer to FIG. 13) at which the detected voltage Vdet is equal to or greater than the certain third threshold Vth3 (V1<Vth3<V1+Vp), and calculates the series capacitance value N×C23 using Equation (13).

Subsequently, the common voltage adjuster 35 calculates the penetration voltage ΔVp on the basis of the parallel capacitance value N×C12 determined at Step S102, the first capacitance value N×C1 determined at Step S103, and the series capacitance value N×C23 determined at Step S104 (Step S105).

More specifically, the arithmetic unit 354 substitutes the parallel capacitance value N×C12 and the first capacitance value N×C1 into Equation (9) to determine the second capacitance value N×C2.

Subsequently, the arithmetic unit 354 substitutes the second capacitance value N×C2 and the series capacitance value N×C23 into Equation (10) to determine the third capacitance value N×C3.

The arithmetic unit 354 then substitutes the second capacitance value N×C2 determined by Equation (9) and the third capacitance value N×C3 determined by Equation (10) into Equation (6) to determine the penetration voltage ΔVp.

Subsequently, the common voltage adjuster 35 selects the offset voltage Voft depending on the penetration voltage ΔVp using the offset voltage table stored in the storage 356 in advance (Step S106).

More specifically, the common voltage setter 355 selects the offset voltage Voft depending on the penetration voltage ΔVp calculated by the arithmetic unit 354 at Step S105, on the basis of the offset voltage table stored in the storage 356.

Subsequently, the common voltage adjuster 35 calculates the common voltage Vcom to be used when the display operation of the display device 1 is performed (Step S107).

More specifically, the common voltage setter 355 subtracts the offset voltage Voft selected at Step S106 from the initial value Vcomset of the common voltage Vcom stored in the storage 356 to calculate the common voltage to be used when the display operation of the display device 1 is performed (Vcom=Vcomset−Voft) and ends the common voltage adjustment processing.

The common voltage adjustment processing may be performed for any one row of pixels Pix in the display area 21, or the common voltage adjustment processing may be performed for any plurality of rows or all rows of pixels Pix to determine an average of the common voltages calculated row by row to be the common voltage to be used when the display operation of the display device 1 is performed.

The display operation of the display device 1 is performed using the common voltage Vcom (=Vcomset−Voft) determined by executing the above-described processing, thereby maintaining the symmetry between the positive potential and the negative potential of the pixel electrode relative to the common voltage Vcomset−Voft after the TFT element Tr has made a transition from a conducting state to a non-conducting state. This can lessen the occurrence of flickers.

The parallel capacitance value C12 (N×C12 in this example), the first capacitance value C1 (N×C1 in this example), and the series capacitance value C23 (N×C23 in this example) are detected using the transient characteristics of the rising edge of the detection drive pulse, and the arithmetic processing is performed for the subsequent processing, whereby the common voltage to be used when the display operation of the display device 1 is performed can be determined, and the time taken for the common voltage adjustment can be reduced.

In the above-described example, the transient characteristics of the detected voltage Vdet at the rising edge of the detection drive pulse are used, although the transient characteristics of the detected voltage Vdet at the falling edge of the detection drive pulse may be used to detect the parallel capacitance value C12 (N×C12 in this example), the first capacitance value C1 (N×C1 in this example), and the series capacitance value C23 (N×C23 in this example).

The above-described common voltage adjustment processing may be performed in the process of product inspection or adjustment before shipment of liquid crystal panels, for example, thereby eliminating the need for providing an inspection device for detecting flickers for each production line or inspection line of the liquid crystal panels, thus contributing to a reduction in manufacturing costs.

The above-described common voltage adjustment processing may be performed by a command signal from the control circuit 100 of an electronic apparatus in which the display device 1 is provided, for example, thereby enabling common voltage adjustment after shipment of liquid crystal panels and electronic apparatuses.

The above-described common voltage adjustment processing may be performed at the time of the start-up of the electronic apparatus in which the display device 1 is provided, for example, thereby enabling automatic adjustment such that flickers caused by the penetration voltage of ΔVp are constantly lessened to the visibility limit or less even when liquid crystal panels have degraded with time, for example.

When the parallel capacitance value N×C12 is detected at Step S102, the second voltage V2 may be output from the gate driver 32 in place of being output from the voltage generation circuit 352*a*. Further, the second voltage V2 in this process may correspond to a high period of the vertical scanning pulse signal.

When the first capacitance value N×C1 is detected at Step S103, and when the series capacitance value N×C23 is detected at Step S104, the first voltage V1 may be output from the gate driver 32 in place of being output from the voltage generation circuit 352*a*. Further, the first voltage V1 in this process may be a low period of the vertical scanning pulse signal.

The detection drive pulse to be used when the parallel capacitance value N×C12 is detected at Step S102 and when the first capacitance value N×C1 is detected at Step S103 may be output from the source driver 33. Further, the detection drive pulse in this process may be a pixel signal.

The detection drive pulse to be used when the series capacitance value N×C23 is detected at Step S104 may be output from the common electrode driver 34. Further, when the display device 1 is a touch detection function-equipped display device, and when the common electrode supplies a drive signal for touch detection at the time of touch detection operation, the detection drive pulse output from the common electrode driver 34 may be the drive signal for touch detection.

Various kinds of signals of the respective drivers are thus used as the first voltage V1, the second voltage V2, and the detection drive pulse, thereby enabling Step S102 for detecting the parallel capacitance value N×C12, Step S103 for detecting the first capacitance value N×C1, and Step S104 for detecting the series capacitance value N×C23 to be performed in one frame each, for example. Consequently, the time required for the common voltage adjustment can be reduced more than ever before.

In the above embodiment, the common electrode COM is shared among all the pixels Pix, although the common electrode COM may be divided into a plurality of strips each of which corresponds a plurality of rows or a plurality of columns, or divided into a plurality of parts arranged in a matrix (a row-column configuration).

In the above embodiment, when the TFT element Tr is in a conducting state, the parallel capacitance value C12 (N×C12 in the example illustrated in FIG. 15) is detected. After that, the TFT element Tr is brought into a non-conducting state, and the first capacitance value C1 (N×C1 in the example illustrated in FIG. 15) and the series capacitance value C23 (N×C23 in the example illustrated in FIG. 15) are detected. However, the embodiment is not limited thereto. For example, before detecting the parallel capacitance value C12, the series capacitance value C23 (N×C23) and the first capacitance value C1 (N×C1) may be detected when the TFT element Tr is in a non-conducting state. After that, the parallel capacitance value C12 (N×C12) may be detected when the TFT element Tr is in a conducting state, for example. Alternatively, the first capacitance value C1 (N×C1) may be detected when the TFT element Tr is in a non-conducting state, the parallel capacitance value C12 (N×C12) may be detected when the TFT element Tr is in a conducting state, and the series capacitance value C23 (N×C23) may then be detected when the TFT element Tr is in a non-conducting state, for example. The present invention is not limited by the order of detecting the parallel capacitance value C12 (N×C12), the first capacitance value C1 (N×C1), and the series capacitance value C23 (N×C23).

As described above, the display device 1 according to the embodiment includes the pixels Pix, the signal lines DTL, the scanning lines SCL, the pixel electrodes, and the common electrode driver 34. The pixels Pix are provided on the display area 21 of the display panel 2 functioning as the display unit that displays images, and each of the pixel Pix includes the TFT element (the transistor element) Tr. One (the first terminal) of the source and the drain of the TFT element (the transistor element) Tr is coupled to a corresponding one of the signal lines DTL. The gate (the second terminal) of the TFT element (the transistor element) Tr is coupled to a corresponding one of the scanning lines SCL. Each of the pixel electrodes is provided at the other (the third terminal) of the source and the drain of the corresponding TFT element (the transistor element) Tr. The common electrode driver 34 applies the common voltage Vcom to the common electrode COM. The display device 1 performs the display operation by the inversion driving method (the frame inversion driving method). In the inversion driving method, the pixel signals to be written into the pixels Pix via the signal lines DTL are inverted at the certain cycle (for each successive frame, each frame corresponding to a single screen, for example). The display device 1 and the method for adjusting the common voltage of the display device 1 according to the embodiment adjusts the common voltage Vcom on the basis of the first capacitance value C1 between the one (the first terminal) of the source and the drain of the TFT element (the transistor element) Tr and the gate (the second terminal) of the TFT element (the transistor element) Tr, the second capacitance value C2 between the other (the third terminal) of the source and the drain of the TFT element (the transistor element) Tr and the gate (the second terminal) of the TFT element (the transistor element) Tr, and the third capacitance value C3 included in between the pixel electrode and the common electrode COM.

More specifically, the common voltage adjuster 35 calculates the parallel capacitance value C12 of the first capacitance value C1 and the second capacitance value C2 when the TFT element (the transistor element) Tr is in a conducting state and calculates the first capacitance value C1 and the series capacitance value C23 of the second capacitance value C2 and the third capacitance value C3 when the TFT element (the transistor element) Tr is in a non-conducting state.

The common voltage adjuster 35 calculates the second capacitance value C2 using Equation (4) or Equation (9) on the basis of the parallel capacitance value C12 and the first capacitance value C1. The common voltage adjuster 35 calculates the third capacitance value C3 using Equation (5) or Equation (10) on the basis of the calculated second capacitance value C2 and series capacitance value C23. Further, the common voltage adjuster 35 calculates the penetration voltage (the feed-through voltage) ΔVp using Equation (1) or Equation (6) on the basis of the second capacitance value C2 and the third capacitance value C3. The common voltage adjuster 35 subtracts the offset voltage Voft depending on the penetration voltage (the feed-through voltage) ΔVp from the initial value Vcomset of the common voltage Vcom set in advance (Vcomset−Voft) to calculate the common voltage Vcom (=Vcomset−Voft) at the time of the display operation of the display device 1.

This calculation maintains the symmetry between the positive potential and the negative potential of the pixel electrode relative to the common voltage Vcom (Vcomset−Voft) after the TFT element (the transistor element) Tr has made a transition from a conducting state to a non-conducting state and can lessen the occurrence of flickers.

The present embodiment achieves a display device that can optimize the voltage to be applied to the common electrode in a shorter time without using any inspection device for detecting flickers.

In the above-described embodiment, the components included therein can be combined. Other operational advantages accruing from the aspects described in the embodiment herein that are obvious from the description herein, or that are appropriately conceivable by those skilled in the art will naturally be understood as accruing from the present invention.

What is claimed is:

1. A display device comprising:

a plurality of pixels provided in a display area of a display unit that displays images, the pixels each including a transistor element;

a plurality of signal lines, one of a source and a drain of each transistor element being coupled to a corresponding one of the signal lines;

a plurality of scanning lines, a gate of the transistor element being coupled to a corresponding one of the scanning lines;

a plurality of pixel electrodes, the other of the source and the drain of the transistor element being coupled to a corresponding one of the pixel electrodes; and a common electrode driver that applies a common voltage to a common electrode, wherein the display device is configured to perform display operation by an inversion driving method that inverts, at a certain cycle, pixel signals to be written into the pixels via the signal lines, wherein the display device further comprises a common voltage adjuster configured to adjust the common voltage based on a first capacitance value between one of the source and the drain of the transistor element and the gate of the transistor element, a second capacitance value between the pixel electrode and the gate of the transistor element, and a third capacitance value between the pixel electrode and the common electrode, and wherein the common voltage adjuster comprising a detector configured to detect the first capacitance value, the second capacitance value, and the third capacitance value.

2. A display device comprising:

a plurality of pixels provided in a display area of a display unit that displays images, the pixels each including a transistor element;

a plurality of signal lines, one of a source and a drain of each transistor element being coupled to a corresponding one of the signal lines;

a plurality of scanning lines, a gate of the transistor element being coupled to a corresponding one of the scanning lines;

a plurality of pixel electrodes, the other of the source and the drain of the transistor element being coupled to a corresponding one of the pixel electrodes; and a common electrode driver that applies a common voltage to a common electrode, wherein the display device is configured to perform display operation by an inversion driving method that inverts, at a certain cycle, pixel signals to be written into the pixels via the signal lines, wherein the display device further comprises a common voltage adjuster configured to adjust the common voltage based on a first capacitance value between one of the source and the drain of the transistor element and the gate of the transistor element, a second capacitance value between the pixel electrode and the gate of the transistor element, and a third capacitance value between the pixel electrode and the common electrode, and wherein the common voltage adjuster calculates a parallel capacitance value of the first capacitance value and the second capacitance value when the transistor element is in a conducting state and calculates the first capacitance value and a series capacitance value of the second capacitance value and the third capacitance value when the transistor element is in a non-conducting state.

3. The display device according to claim 2, wherein the common voltage adjuster calculates the second capacitance value using Equation (1):

$$C2=C12-C1 \quad (1)$$

where C2 is the second capacitance value, C12 is the parallel capacitance value, and C1 is the first capacitance value.

4. The display device according to claim 3, wherein the common voltage adjuster calculates the third capacitance value using Equation (2):

$$C3=C2\times C23/(C2-C23) \quad (2)$$

where C3 is the third capacitance value, and C23 is the series capacitance value.

5. The display device according to claim 4, wherein the common voltage adjuster adjusts the common voltage in accordance with a penetration voltage calculated using Equation (3):

$$\Delta Vp=(C2/(C2+C3))\times Vg \quad (3)$$

where ΔVp is the penetration voltage, and Vg is a wave height value of a vertical scanning pulse signal to be applied to the gate of the transistor element at the display operation.

6. The display device according to claim 5, wherein the common voltage adjuster subtracts an offset voltage Voft depending on the penetration voltage ΔVp from an initial value Vcomset of the common voltage set in advance.

7. A display device comprising:

a plurality of pixels provided in a display area of a display unit that displays images, the pixels each including a transistor element;

a plurality of signal lines, one of a source and a drain of each transistor element being coupled to a corresponding one of the signal lines;

a plurality of scanning lines, a gate of the transistor element being coupled to a corresponding one of the scanning lines;

a plurality of pixel electrodes, the other of the source and the drain of the transistor element being coupled to a corresponding one of the pixel electrodes; and a common electrode driver that applies a common voltage to a common electrode, wherein the display device is configured to perform display operation by an inversion driving method that inverts, at a certain cycle, pixel signals to be written into the pixels via the signal lines, and wherein the display device further comprises a common voltage adjuster configured to adjust the common voltage based on a first capacitance value between one of the source and the drain of the transistor element and the gate of the transistor element, a second capacitance value between the pixel electrode and the gate of the transistor element, and a third capacitance value between the pixel electrode and the common electrode, wherein the pixels are arranged in a matrix of M rows×N columns in the display area, each of M and N being a natural number, wherein the gates of the transistor elements of N pixels included in one row are coupled to one of the scanning lines, wherein, when the transistor element of each of N pixels included in one row is in a conducting state, the common voltage adjuster calculates a total capacitance value of the parallel capacitance values of N pixels, each of which is the parallel capacitance value of the first capacitance value and the second capacitance value of the transistor element, and wherein, when the transistor element of each of N pixels included in one row is in a non-conducting state, the common voltage adjuster calculates a total capacitance value of the first capacitance values of the transistor elements of N pixels and calculates a total capacitance value of the series capacitance values of N pixels, each of which is the series capacitance value of the second capacitance value and the third capacitance value of the transistor element.

8. The display device according to claim 7, wherein the common voltage adjuster calculates a total capacitance value of the second capacitance values of the transistor elements of N pixels using Equation (4):

$$N\times C2=N\times C12-N\times C1 \quad (4)$$

where N×C2 is the total capacitance value of the second capacitance values, N×C12 is the total capacitance value of the parallel capacitance values, and N×C1 is the total capacitance value of the first capacitance values.

9. The display device according to claim 8, wherein the common voltage adjuster calculates a total capacitance value of the third capacitance values of N pixels using Equation (5):

$$N\times C3=N\times C2\times N\times C23/(N\times C2-N\times C23) \quad (5)$$

where N×C3 is the total capacitance value of the third capacitance values, and N×C23 is the total capacitance value of the series capacitance values.

10. The display device according to claim 9, wherein the common voltage adjuster adjusts the common voltage in accordance with a penetration voltage ΔVp calculated using Equation (6):

$$\Delta Vp=(N\times C2/(N\times C2+N\times C3))\times Vg \quad (6)$$

where ΔVp is the penetration voltage, and Vg is a wave height value of a vertical scanning pulse signal to be applied to the gate of the transistor element at the display operation.

11. The display device according to claim 10, wherein the common voltage adjuster subtracts an offset voltage Voft depending on the penetration voltage ΔVp from an initial value Vcomset of the common voltage set in advance.

12. A method for adjusting a common voltage of a display device, the display device including a display unit that displays images, a plurality of pixels provided in a display area of the display unit, the pixels each including a transistor element, a plurality of signal lines, one of a source and a drain of each transistor element being coupled to a corresponding one of the signal lines, a plurality of scanning lines, a gate of the transistor element being coupled to a corresponding one of the scanning lines, a plurality of pixel electrodes, the other of the source and the drain of the transistor element being coupled to a corresponding one of the pixel electrodes, a common electrode driver that applies a common voltage to a common electrode, the display device being configured to perform display operation by an inversion driving method that inverts, at a certain cycle, pixel signals to be written into the pixels via the signal lines, and a detector, the method comprising:

detecting, by the detector, a first capacitance value between one of the source and the drain of the transistor element and the gate of the transistor element, a second capacitance value between the pixel electrode and the gate of the transistor element, and a third capacitance value between the pixel electrode and the common electrode; and adjusting the common voltage based on the first capacitance value, the second capacitance value, and the third capacitance value.

13. A method for adjusting a common voltage of a display device, the display device including a display unit that displays images, a plurality of pixels provided in a display area of the display unit, the pixels each including a transistor element, a plurality of signal lines, one of a source and a drain of each transistor element being coupled to a corresponding one of the signal lines, a plurality of scanning lines, a gate of the transistor element being coupled to a corresponding one of the scanning lines, a plurality of pixel electrodes, the other of the source and the drain of the transistor element being coupled to a corresponding one of the pixel electrodes, and a common electrode driver that applies a common voltage to a common electrode, the display device being configured to perform display operation by an inversion driving method that inverts, at a certain cycle, pixel signals to be written into the pixels via the signal lines, the method comprising adjusting the common voltage based on a first capacitance value between one of the source and the drain of the transistor element and the gate of the transistor element, a second capacitance value between the pixel electrode and the gate of the transistor element, and a third capacitance value between the pixel electrode and the common electrode, wherein the method comprising:

calculating a parallel capacitance value of the first capacitance value and the second capacitance value when the transistor element is in a conducting state;

calculating the first capacitance value when the transistor element is in a non-conducting state;

calculating a series capacitance value of the second capacitance value and the third capacitance value when the transistor element is in a non-conducting state;

calculating the second capacitance value based on the parallel capacitance value and the first capacitance value;

calculating the third capacitance value based on the second capacitance value and the series capacitance value; and adjusting the common voltage based on the second capacitance value and the third capacitance value.

14. A display device comprising:

a plurality of pixels provided in a display area of a display unit that displays images, the pixels each including a transistor element;

a plurality of signal lines, one of a source and a drain of each transistor element being coupled to a corresponding one of the signal lines;

a plurality of scanning lines, a gate of the transistor element being coupled to a corresponding one of the scanning lines;

a plurality of pixel electrodes, the other of the source and the drain of the transistor element being coupled to a corresponding one of the pixel electrodes;

a common electrode facing the pixel electrodes;

a detection circuit including an input terminal capable of receiving, via a resistor, a first voltage for bringing the transistor element into a non-conducting state or a second voltage for bringing the transistor element into a conducting state;

a first switch one terminal of which is coupled to a corresponding one of the scanning lines and another terminal of which is coupled to a gate driver;

a second switch capable of coupling either a source driver or a detection drive pulse generation circuit to a corresponding one of the signal lines;

a third switch capable of coupling either a common electrode driver or the detection drive pulse generation circuit to the common electrode; and a fourth switch one terminal of which is coupled to a corresponding one of the scanning lines and another terminal of which is coupled to the input terminal of the detection circuit, the display device performing display operation by an inversion driving method that inverts pixel signals to be written into the pixels via the signal lines at a certain cycle.

15. The display device according to claim 14, further comprising a common voltage adjuster configured to adjust the common voltage based on a first capacitance value between one of the source and the drain of the transistor element and the gate of the transistor element, a second capacitance value between the pixel electrode and the gate of the transistor element, and a third capacitance value between the pixel electrode and the common electrode.

16. The display device according to claim 15, wherein the display device causes the first voltage to be supplied to the input terminal of the detection circuit via the resistor, brings the first switch and the third switch into a non-conducting state, brings the fourth switch into a conducting state, causes a drive pulse generated by the detection drive pulse generation circuit to be supplied to the pixel electrode via the second switch, and measures a voltage of the scanning line by the detection circuit to measure the first capacitance value;

causes the second voltage to be supplied to the input terminal of the detection circuit via the resistor, brings the first switch and the third switch into a non-conducting state, brings the fourth switch into a conducting state, causes the drive pulse generated by the detection drive pulse generation circuit to be supplied to the pixel electrode via the second switch, and measures the voltage of the scanning line by the detection circuit to measure a parallel capacitance of the first capacitance value and the second capacitance value;

causes the first voltage to be supplied to the input terminal of the detection circuit via the resistor, brings the first switch and the second switch into a non-conducting state, brings the fourth switch into a conducting state, causes the drive pulse generated by the detection drive pulse generation circuit to be supplied to the pixel electrode via the third switch, and measures the voltage of the scanning line by the detection circuit to measure a series capacitance of the second capacitance value and the third capacitance value; and calculates the first capacitance value, the second capacitance value, and the third capacitance value.

* * * * *